United States Patent [19]

Ganter

[11] Patent Number: 4,765,023

[45] Date of Patent: Aug. 23, 1988

[54] SPRING BIASED LOCKABLE SAFETY HANDLE FOR TURNING A HAND CONTROL WHEEL

[76] Inventor: Bernhard Ganter, Tribergerstrasse 3, D-7743 Furtwangen 1, Fed. Rep. of Germany

[21] Appl. No.: 81,608

[22] Filed: Aug. 3, 1987

Related U.S. Application Data

[63] Continuation of Ser. No. 799,835, Nov. 20, 1985, abandoned.

[30] Foreign Application Priority Data

Dec. 7, 1984 [DE] Fed. Rep. of Germany ... 8435801[U]

[51] Int. Cl.[4] ..... B25G 1/00

[52] U.S. Cl. ..... 16/112; 74/548; 74/557

[58] Field of Search ..... 16/112, 117, 123; 74/543, 545, 548, 552, 553, 555, 557

[56] References Cited

U.S. PATENT DOCUMENTS

| | | | |
|---|---|---|---|
| 3,313,386 | 4/1967 | Schwalm | 74/548 X |
| 3,986,409 | 10/1976 | Tripp et al. | 74/548 |
| 4,037,488 | 7/1977 | Laney, Sr. | 74/545 X |
| 4,475,415 | 10/1984 | Yamamoto | 74/543 |
| 4,549,716 | 10/1985 | Warren | 74/548 X |

FOREIGN PATENT DOCUMENTS

G8303687 6/1983 Fed. Rep. of Germany .

*Primary Examiner*—Fred A. Silverberg
*Attorney, Agent, or Firm*—Wegner & Bretschneider

[57] ABSTRACT

Disclosed is a safety handle for turning a hand control wheel. The handle is engaged by exerting constant axial pressure on the handle in a swung-out position, which enables the hand control wheel to be turned. Upon release of the handle, it automatically swings back to the retracted position into the hand control wheel. The handle is locked in the wheel-turning position by way of a shoulder/detent engagement.

3 Claims, 1 Drawing Sheet

SPRING BIASED LOCKABLE SAFETY HANDLE FOR TURNING A HAND CONTROL WHEEL

This application is a continuation of U.S. application Ser. No. 799,835, filed Nov. 20, 1985, now abandoned.

BACKGROUND OF THE INVENTION

The invention concerns a safety handle for hand control wheels and the like, which is swivel mounted on an attachment part and which in an initial position operates in a sliding fashion against axial spring pressure in the direction of the attachment part and in which position is secured against swivelling and which can be swivelled out of this first position over about 90° into a second position.

Such safety handles are, in the second so-called swivelled position, retractable into a hand control wheel in which, in the initial, swing-out position enables the hand control wheel to be turned. The handle is, in this case, always retracted under spring pressure, i.e. it must not be lockable so long as no axial pressure is applied to it. The reason for this is, therefore, that the handle is always automatically retracted into the hand control wheel when it is not under pre-loaded axial pressure. Under this axial pressure the handle is then locked in such a way that it cannot be retracted from its initial vertically swung position into the second position in the hand control wheel.

This problem is solved in the German utility model document No. 83 03 687,3 in that a lower axial locking bolt is built in to the attached part which is spring loaded in the direction of the handle. If the handle is now loaded in an axial direction against a coil spring, the locking bolt engages in a central bore in an extension of the handle thus locking both parts.

A disadvantage of this known design is, however, that this is very complicated and extravagant in that the mounting for the locking bolt has to be dealt with in the attachment itself, in wihch specific recesses and fittings are required. The machining of the handle itself is complicated further by being fitted with lateral pins, bearing bushes and several springs.

BRIEF SUMMARY OF THE INVENTION

The purpose of the present invention is the further development of a safety handle of the type described in the introduction in such a way that an essentially simpler and more defect-free design is guaranteed.

To achieve this aim, the invention is characterized in that the axial locking between the handle and the attached part is achieved by a locking shoulder which functions in conjugation with a detent in the other part.

It is preferred that a thread is provided on the underside of the attachment in the axis of the handle in its locking position. This is a particularly space-saving and centralized fitting of the attachment to the hand wheel, which is not possible in the case of the mentioned utility model document because therein this space is occupied by the spring-loaded locking pin.

It is additionally preferred when an annular chamber is formed in the handle pivot bolt, which is freely accessible from one side and in which a torsion spring is fitted which is fixed in the pivot bolt and whose end engages in a recess in the attachment. In this fashion, therefore, the handle is pre-loaded by spring pressure in its second position and swivels, thereby, automatically into this position when it is not locked in its first position. The torsion spring requires little space and creates sufficient spring loading for the automatic swivelling of the handle.

In this case, it is preferred when the recess is accessible from the upper side of the attachment. In this way the assembly of these parts is further simplified.

Finally, it is preferred when the handle consists of a plastic cap and an aluminium grip bolt. The handle is therefore very light without losing any functional efficiency, the inertia to be overcome during swivelling being noticeably reduced so that the swivel action takes place very quickly, which means a correspondingly weaker spring can be fitted which also requires less space.

The innovation is explained in the following by an embodiment example from which arise further important features. Protection is also claimed for possible combinations of the disclosed inventive ideas.

DETAILED DESCRIPTION

Figures 1, 2:
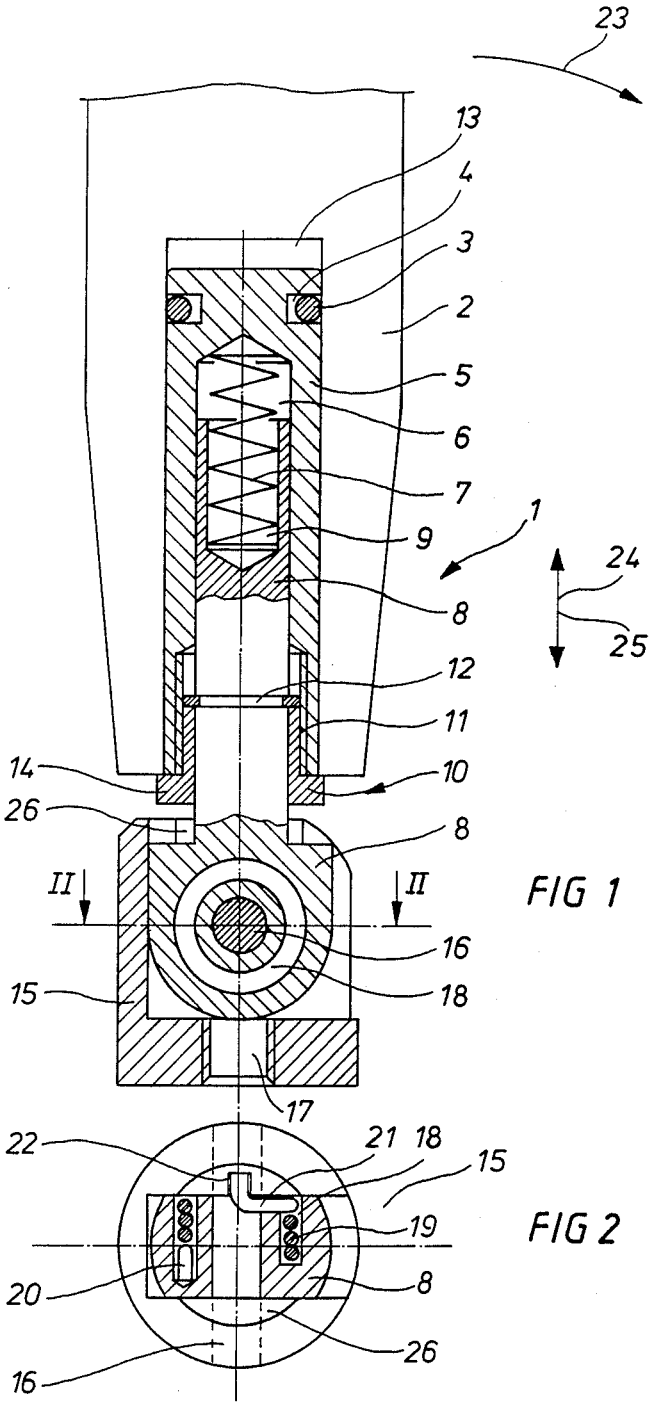
FIG. 1 shows a longitudinal section through an innovative safety handle in its first position.
FIG. 2 is a cross section through II—II of FIG. 1.

In accordance with FIG. 1, a hand grip (1) has an outer part (2), preferrably of plastic, which has a central drilling (13) whose inner side is a force-fit on the external circumference of a spring ring (3) which is fitted in an annular slot (4) in the grip bolt (5) arranged in the central drilling (13).

The grip bolt (5) has an internal thread by which it is screwed onto a corresponding external thread of a centering screw (10).

The grip bolt (5) has a central drilling (6) in which is fitted a coil spring (7) which also engages in an opposite central drilling (9) of a pivot bolt (8). The coil spring (7) pre-loads the pivot bolt (8) against the grip bolt (5).

An annular slot is cut in the external circumference of the pivot bolt (8) in which is fitted a circlip (12) which accepts the spring force and which abuts the centering screw (10).

The complete handle (1) is capable of being swivelled in the direction of arrow (23) about a pin (16) which is arranged as a lateral pin in an attachment (15) whereby the attachment (15) itself, by means of the thread (17) and screw (not shown) is screwed to the hand wheel (not shown).

In this fashion therefore, the attachment (15) is connected to the hand wheel.

In order to guarantee that the handle (1) is always automatically swung in the arrow direction (23), towards the right in FIG. 1, a pre-loaded torsion spring (19) is provided, the fitting of which is described in the following:

An annular chamber (18) is located in pivot bolt (8) into which the torsion spring (19) is pressed, in a pre-loaded condition. One end (20) of the torsion spring (19) engages in a blind hole (not shown) in the pivot bolt (8) and the opposite end (21) of the torsion spring (19) engages in a corresponding recess (22), also on the attachment (15), in the area of the pivot bolt (8).

The torsion spring (19) is so pre-loaded as to ensure that under the spring force, the handle (1) always swings automatically in the direction of arrow (23) towards the right.

If the handle (1) moves downwards in arrow direction (25) against the force of the coil spring (7), the radial external locking shoulder (14) engages with the axial and adjacently aligned locking recess (26), so that both parts are locked thus preventing any pivoting, i.e. the swivel movement in the direction of arrow (23) can no longer take place. Only in this locked position, which can only be maintained against the force of spring (7), can the hand wheel be turned.

As soon as the handle (1) is released, the coil spring (7) forces the handle (1) upwards in the direction of arrow (24) so that the locking shoulder (14) disengages from the corresponding locking recess (26) in the attachment (15), and the lever automatically swings away to the right again in arrow direction (23).

The advantage of the described design is the particular simplicity as no spring-loaded locking bolts or the like are required as were provided in the case of the utility model No. G83 03 687,3.

A further advantage is the large locking force as the locking shoulder (14) and corresponding locking recess (26) are arranged radially, enabling the transmission of high bending moments, which is not possible with the centrally arranged locking bolts in the case of the utility model quoted in the introduction which is centrally arranged and has correspondingly high shear loads.

Further, it emphasized that the fitting of the innovate handle with the attachment (15) is particularly easy because it is possible to secure the attachment (15) to the hand wheel by means of the centrally positioned threaded bore (11) which is not possible in the case of the utility model as an offset threaded bore was required there.

In the preferred embodiment example the external part (2) consists of a plastic material to guarantee the smallest possible mass for the swivel movement in arrow direction (23) and in the opposite direction.

It is further preferred that the grip bolt (5) consists of aluminium material to make the complete part light to ensure an easy swinging movement. One can therefore use a relatively small-gauge torsion spring (19).

Areas of usage for the innovation to be taken into consideration are all those in which a part can be locked by axial pressure opposite to another part in a first position, and where a part can be swivelled into a second position relative to it.

What I claim is:

1. A safety handle for turning a hand control wheel comprising:

(a) an attachment part fixed to said wheel and having a pivot axis;

(b) a handle part having a handle axis, a pivot part annular about said pivot axis, and a grip part radial to said pivot axis along said handle axis;

(c) a torsion spring displaced in an annular chamber in said handle part;

(d) mounting means for mounting said handle part on said attachment part such that said handle axis intersects said pivot axis, said annular chamber surrounds said pivot axis, said handle part can swivel about said pivot axis from a wheel-turning position that is swung-out from said wheel to a retracted position that is swung into said wheel, and said torsion spring exerts a force against said handle part directed toward said retracted position;

(e) a shoulder on said grip part capable of engaging a detent in said attachment part while in said wheel-turning position, said detent being located away from said pivot axis in the direction of said grip part while in said wheel-turning position, and (f) engaging means for engaging said shoulder with said detent to lock said handle part in said wheel turning position such that constant force must be applied against said handle part along said handle axis directed toward said attachment part.

2. A safety handle as in claim 1, wherein said engaging means comprises:

(a) an outer part of said handle part that contains a drilling;

(b) a grip bolt that contains a bore;

(c) a pivot bolt mounted in said bore that contains said annular chamber;

(d) means for force-fitting said grip bolt in said drilling;

(e) means for maintaining said pivot bolt in said bore such that said outer part can move along said handle axis for some distance with respect to said pivot bolt, and (f) a spring located in said bore and exerting a force against said pivot bolt along said handle axis.

3. A safety handle as in claim 2, wherein said outer part is comprised of plastic, and said grip bolt is comprised of aluminum.

* * * * *